US009132462B2

(12) United States Patent
Lee et al.

(10) Patent No.: US 9,132,462 B2
(45) Date of Patent: Sep. 15, 2015

(54) BENDING PRESS SYSTEM

(71) Applicant: SUNGWOO HITECH CO., LTD., Busan (KR)

(72) Inventors: Mun Yong Lee, Busan (KR); Tae Wook Yoon, Busan (KR)

(73) Assignee: SUNGWOO HITECH CO., LTD., Busan (KR)

( * ) Notice: Subject to any disclaimer, the term of this patent is extended or adjusted under 35 U.S.C. 154(b) by 356 days.

(21) Appl. No.: 13/721,189

(22) Filed: Dec. 20, 2012

(65) Prior Publication Data

US 2014/0157853 A1 Jun. 12, 2014

(30) Foreign Application Priority Data

Dec. 11, 2012 (KR) ..... 10-2012-0143592

(51) Int. Cl.
*B21D 7/00* (2006.01)
*B21D 22/02* (2006.01)
*B21D 7/02* (2006.01)

(52) U.S. Cl.
CPC ..... *B21D 22/025* (2013.01); *B21D 7/02* (2013.01); *B21D 7/00* (2013.01)

(58) Field of Classification Search
CPC ..... B21D 5/04; B21D 5/042; B21D 11/02; B21D 1/14; B21D 22/22; B21D 24/08; B21D 24/02; B21D 24/14; B21D 25/02; B21D 5/02; B21D 5/0236; B21D 5/028; B21D 22/025; B21D 7/06; B21D 7/00; B21D 7/02
USPC ..... 72/293–323, 466.9, 482.91
See application file for complete search history.

(56) References Cited

U.S. PATENT DOCUMENTS

2012/0198904 A1* 8/2012 Li et al. ..... 72/311

FOREIGN PATENT DOCUMENTS

| | | |
|---|---|---|
| JP | 06-142805 | 5/1994 |
| JP | 2006-116595 | 5/2006 |
| JP | 4603194 | 12/2010 |
| KR | 100873397 B1 | 12/2008 |
| KR | 10-2012-0023884 | 3/2012 |
| KR | 10-2012-0094621 | 8/2012 |
| WO | WO 2011041984 A1 * | 4/2011 |

* cited by examiner

*Primary Examiner* — Livius R Cazan
*Assistant Examiner* — John S Lowe
(74) *Attorney, Agent, or Firm* — Lex IP Meister, PLLC

(57) ABSTRACT

A bending press system is disclosed. The bending press system may include: a base; a slider disposed above the base and moving downwardly toward the base or moving upwardly from the base; a curvature die mounted at the base and the slider, and integrated by descent of the slider such that a pipe member inserted in the curvature die is formed to have a predetermined curvature; and a pair of clamping units disposed to be rotatable by a predetermined angle corresponding to the curvature die at both sides of the base, and clamping both end portions of the pipe member.

11 Claims, 7 Drawing Sheets

BENDING PRESS SYSTEM

CROSS-REFERENCE TO RELATED APPLICATION

This application claims priority to and the benefit of Korean Patent Application No. 10-2012-0143592 filed in the Korean Intellectual Property Office on Dec. 11, 2012, the entire contents of which are incorporated herein by reference.

BACKGROUND OF THE INVENTION (a) Field of the Invention

The present invention relates to a bending press system. More particularly, the present invention relates to a bending press system which is adapted to form a pipe member to have a predetermined curvature in a state that both ends of the pipe member manufactured through extrusion are clamped.

(b) Description of the Related Art

Generally, a bending apparatus is used for forming a beam member to have a predetermined curvature. The bending apparatus is used for forming a shaped beam manufactured through roll-forming or a straight pipe member manufactured through extrusion to have the predetermined curvature. The bending apparatus is particularly applied to a bumper beam for a vehicle.

Such a bending apparatus includes a roll bender, a round bender and a stretch bender.

According to the roll bender, a straight pipe member is inserted in a plurality of bending rolls disposed along a predetermined curvature and rotating and is formed to have a desired curvature. According to the round bender, a plurality of forming rolls is disposed up and down along a curvature radius and a pipe member passes through the forming rolls to have a predetermined curvature.

In addition, the stretch bender pulls both ends of a shaped beam in opposite directions and bends the shaped beam on a die having a predetermined shape. Therefore, the stretch bender can form the shaped beam to have a curvature in a state of controlling strength and spring back.

However, the roll bender is hard to be used for an aluminum extruded pipe member or high-strength steel pipe member and has drawbacks of low dimensional precision when curvature forming.

In addition, initial investment cost is high and productivity is low due to long manufacturing cycle according to the round bender and the stretch bender.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a bending press system having advantages of inducing stable plastic deformation, heightening dimensional precision, and enhancing forming quality.

In addition, the present invention has been made in an effort to provide a bending press system having further advantages of improving productivity by reducing manufacturing cycle due to quick forming.

A bending press system according to one or more exemplary embodiments of the present invention may include: a base; a slider disposed above the base and moving downwardly toward the base or moving upwardly from the base; a curvature die mounted at the base and the slider, and integrated by descent of the slider such that a pipe member inserted in the curvature die is formed to have a predetermined curvature; and a pair of clamping units disposed to be rotatable by a predetermined angle corresponding to the curvature die at both sides of the base, and clamping both end portions of the pipe member.

The curvature die may include: a lower die mounted on the base and including a lower curvature forming surface having the predetermined curvature along a width direction thereof and formed on an upper surface thereof; and an upper die mounted on a lower surface of the slider and including an upper curvature forming surface corresponding to the lower curvature forming surface, having the predetermined curvature along a width direction thereof, and formed on a lower surface thereof.

The clamping unit may include: a clamping die fixed on the base and including a space formed therein; a clamping block positioned in the space of the clamping die, mounted at the clamping die to be rotatable by the predetermined angle through a rotation shaft, and including a receiving end formed to face the curvature die and a supporting end formed at a lower portion thereof; a clamping cylinder mounted at an upper portion of the clamping block to face the receiving end and including an operating rod moving forward or rearward by hydraulic pressure; a clamper mounted at a front end of the operating rod and clamping an end portion of the pipe member inserted between the clamper and the receiving end by pressing the end portion of the pipe member together with the receiving end; and a return spring mounted corresponding to a surface of the supporting end in the space of the clamping die, and applying restoring force to the supporting end so as for the clamping block to rotate to an original position of the clamping block.

A receiving surface for receiving the pipe member may be formed on the receiving end, and contact protrusions may be formed on the receiving surface.

A receiving surface for receiving the pipe member may be formed on the receiving end and may be formed as a scratched surface.

Contact protrusions may be formed on a lower surface of the clamper.

A lower surface of the clamper may be formed as a scratched surface.

The return spring may include a rod and a roller mounted at a front end of the rod, and may slidably contact with the surface of the supporting end through the roller.

The return spring may be a hydraulic pressure spring.

A bending press system according to another exemplary embodiment of the present invention may include: a base; a slider disposed above the base and moving downwardly toward the base or moving upwardly from the base; a curvature die including a lower die mounted on the base and an upper die mounted on a lower surface of the slider, wherein the lower die and the upper die are integrated by descent of the slider such that a pipe member inserted between the lower die and the upper die is formed to have a predetermined curvature; and a pair of clamping units clamping both ends portions of the pipe member, each of the pair clamping units comprising a clamping die fixed on both sides of the base and including a space formed therein, a clamping block positioned in the space of the clamping die, mounted at the clamping die to be rotatable by a predetermined angle through a rotation shaft, and including a receiving end formed to face the curvature die and a supporting end formed at a lower portion thereof, a clamping cylinder mounted at an upper portion of the clamping block to face the receiving end and including an operating rod moving forward or rearward by hydraulic pressure, a clamper mounted at a front end of the operating rod and clamping an end portion of the pipe member inserted between the clamper and the receiving end by pressing the end portion of the pipe member together with the receiving end, and a return spring mounted corresponding to a surface of the supporting end in the space of the clamping die and applying restoring force to the supporting end so as for the clamping block to rotate to an original position of the clamping block.

A lower curvature forming surface having the predetermined curvature along a width direction of the lower die may be formed on an upper surface of the lower die.

An upper curvature forming surface having the predetermined curvature along a width direction of the upper die may be formed on a lower surface of the upper die.

The return spring may include a rod and a roller mounted at a front end of the rod, and may slidably contact with the surface of the supporting end through the roller.

The return spring may be a hydraulic pressure spring.

DESCRIPTION OF SYMBOLS

| | |
|---|---|
| 1: base | 3: slider |
| 5: curvature die | 7: clamping unit |
| 9, 11: die plate | 51: lower die |
| 52: upper die | 71: clamping die |
| 72: clamping block | 73: clamping cylinder |
| 74: clamper | 75: return spring |
| 76: rotation shaft | 77: receiving end |
| 78: supporting end | |

DETAILED DESCRIPTION OF THE EMBODIMENTS

Hereinafter, an exemplary embodiment of the present invention will be described in detail with reference to the accompanying drawings.

Figure 1:
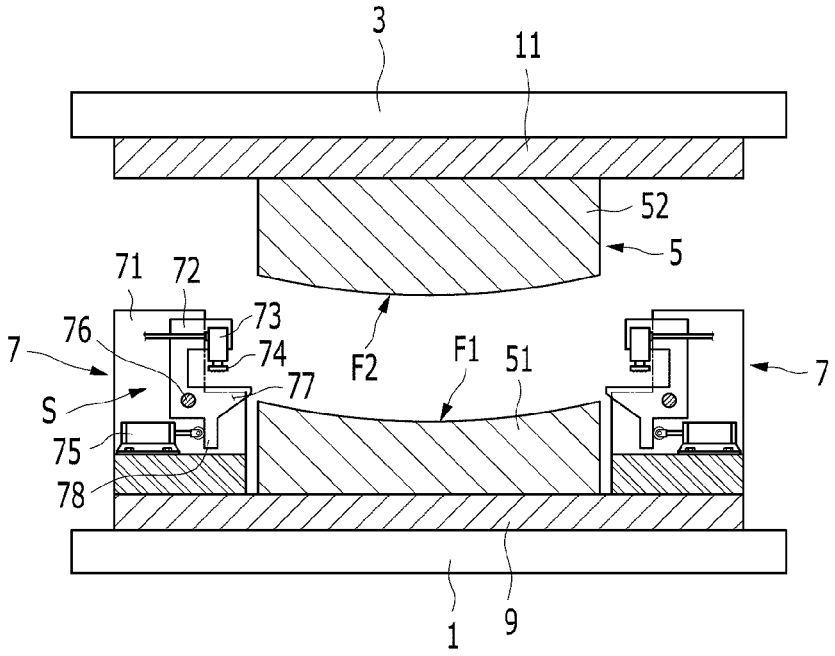
FIG. 1 is a cross-sectional view of a bending press system according to an exemplary embodiment of the present invention.
Figure 2:
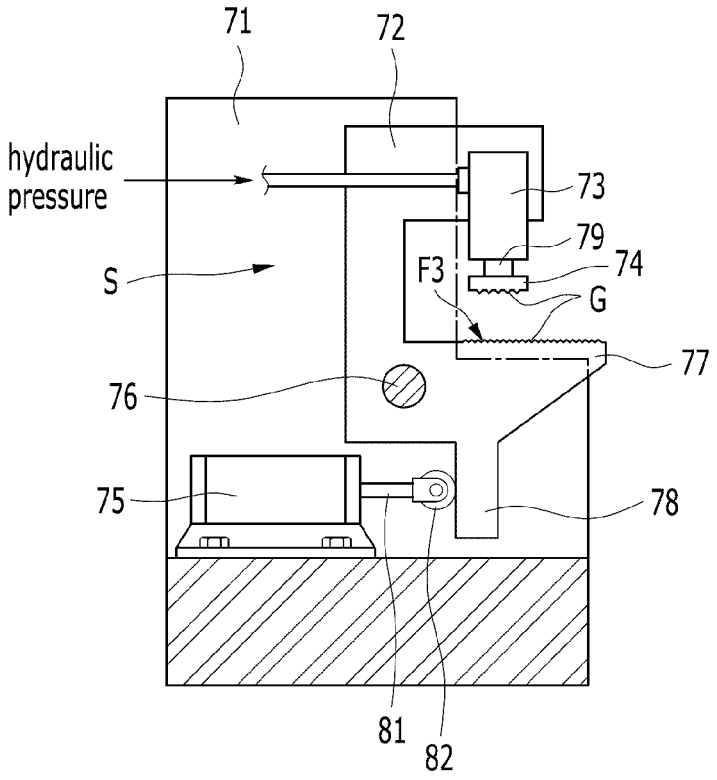
FIG. 2 is a cross-sectional view of a clamping unit applicable to a bending press system according to an exemplary embodiment of the present invention.
Figure 3:
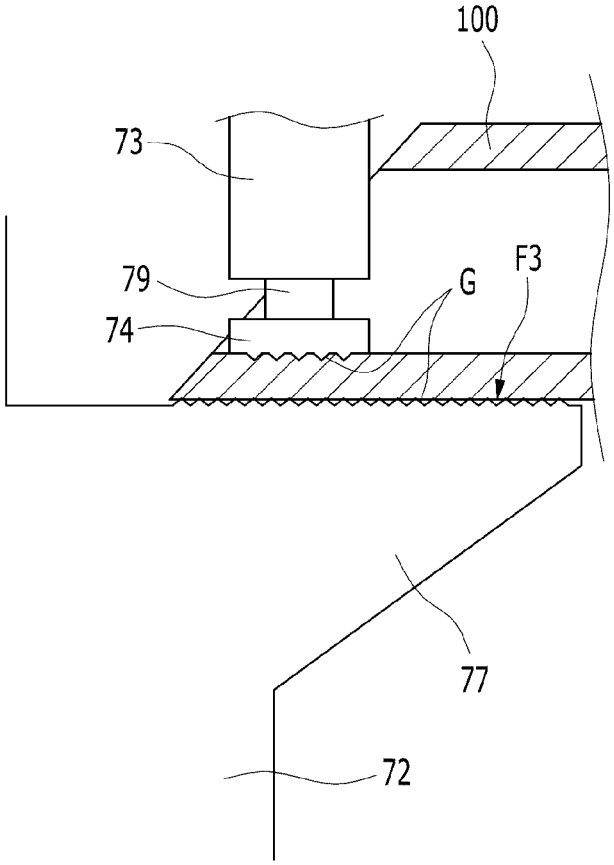
FIG. 3 is an enlarged view of a clamper applicable to a bending press system according to an exemplary embodiment of the present invention.

FIG. 1 is a cross-sectional view of a bending press system according to an exemplary embodiment of the present invention; FIG. 2 is a cross-sectional view of a clamping unit applicable to a bending press system according to an exemplary embodiment of the present invention; and FIG. 3 is an enlarged view of a clamper applicable to a bending press system according to an exemplary embodiment of the present invention.

Referring to FIG. 1, a bending press system according to an exemplary embodiment of the present invention includes a base 1, a slider 3, a curvature die 5 and a clamping unit 7.

The base 1 is mounted at a lower portion of a press machine (not shown).

The slider 3 is positioned above the base 1 and is mounted at the press machine. The slider 3 can move downwardly toward the base 1 or move upwardly from the base 1.

The curvature die 5 is mounted at the base 1 and the slider 3 and is integrated by descent of the slider 3 such that a pipe member inserted in the curvature die 5 is formed to have a predetermined curvature.

The curvature die 5 includes a lower die 51 and an upper die 52.

The lower die 51 is mounted on the base 1 through a die plate 9, and a lower curvature forming surface F1 having a predetermined curvature along a width direction is formed on the lower die 51.

In addition, the upper die 52 is mounted on a lower surface of the slider 3 through a die plate 11, and an upper curvature forming surface F2 corresponding to the lower curvature forming surface F1 and having the predetermined curvature along the width direction is formed at a lower surface of the upper die 52.

A pair of clamping units 7 is disposed corresponding to the lower die 51 on both sides of the base 1 to be rotatable by a predetermined angle. The pair of clamping units 7 clamps both end portions of the pipe member.

As shown in FIG. 2, the clamping unit 7 includes a clamping die 71, a clamping block 72, a clamping cylinder 73, a clamper 74 and a return spring 75.

The clamping die 71 is fixed on the base 1 through the die plate 9 and includes a space S formed therein. The space S opens toward the lower die 51 and the upper die 52.

As shown in FIG. 2 and FIG. 3, the clamping block 72 is positioned in the space S of the clamping die 71 and is mounted at the clamping die 71 to be rotatable by the predetermined angle through a rotation shaft 76. In addition, a receiving end 77 is formed at a side of the clamping block 72 facing the curvature die 5, and a supporting end 78 is protruded downwardly from a lower portion of the clamping block 72. The receiving end 77 and the supporting end 78 are integrally formed with the clamping block 72.

Herein, a receiving surface F3 for receiving the pipe member is formed on the receiving end 77, and contact protrusions G may be formed on the receiving surface F3 or the receiving surface F3 may be formed as a scratched surface. However, a shape of the receiving surface F3 is not limited to this and can have any shape that can prevent slide of the pipe member from the receiving surface F3.

The clamping cylinder 73 is mounted at an upper portion of the side of the clamping block 72 to face the receiving end 77 and includes an operating rod 79 moving forward or rearward by hydraulic pressure.

Herein, the clamping cylinder 73 may be a hydraulic pressure cylinder that is operated by the hydraulic pressure.

Referring to FIG. 3, the clamper 74 is mounted at a front end of the operating rod 79 of the clamping cylinder 73. The clamper 74 clamps an end portion of the pipe member inserted between the clamper 74 and the receiving end 77 by pressing the end portion of the pipe member together with the receiving end.

Herein, contact protrusions G may be formed on a lower surface of the clamper 74 or the lower surface may be formed as a scratched surface. However, a shape of the lower surface of the clamper 74 is not limited to this and can have any shape that can prevent slide of the pipe member from the clamper 74.

The return spring 75 is mounted corresponding to a surface of the supporting end 78 of the clamping block 72 in the space S of the clamping die 71, and applies restoring force to the supporting end 78 so as for the clamping block 72 to rotate to an original position of the clamping block 72.

Herein, the return spring 75 may be a hydraulic pressure spring, but is not limited thereto. That is, the return spring 75 may be any means (for example, elastic member) for supplying the restoring force that rotate the clamping block 72 to its original potion. The return spring 75 transmits the restoring force to the rod 81, and a roller 82 is mounted at a front end of the rod 81. Therefore, the return spring 75 slidably contacts with the surface of the supporting end 78 through the roller 82.

An operation of the bending press system according to an exemplary embodiment of the present invention will be described in detail with reference to FIG. 4 to FIG. 7.

Processes for forming a curvature of a bumper beam for a vehicle using the bending press system according to an exemplary embodiment of the present invention are illustrated in FIG. 4 to FIG. 7. The bumper beam for the vehicle is made of an aluminum extrusion pipe member 100.

Figure 4:
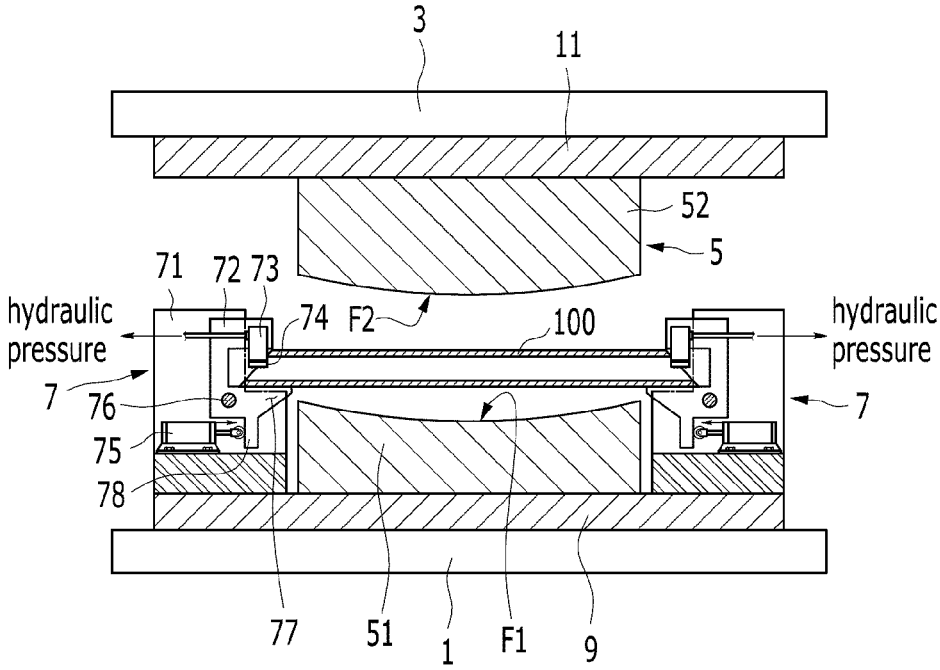
FIG. 4 to FIG. 7 are cross-sectional views for illustrating operation of a bending press system according to an exemplary embodiment of the present invention.

An ascent state of the upper die 52 and the die plate 11 due to ascent of the slider 3 is illustrated in FIG. 4. If the pipe member 100 is inserted between the upper die 52 and the lower die 51 at this state, the both end portions of the pipe member 100 are positioned on the receiving ends 77 of the pair of clamping blocks 72.

Figure 5:
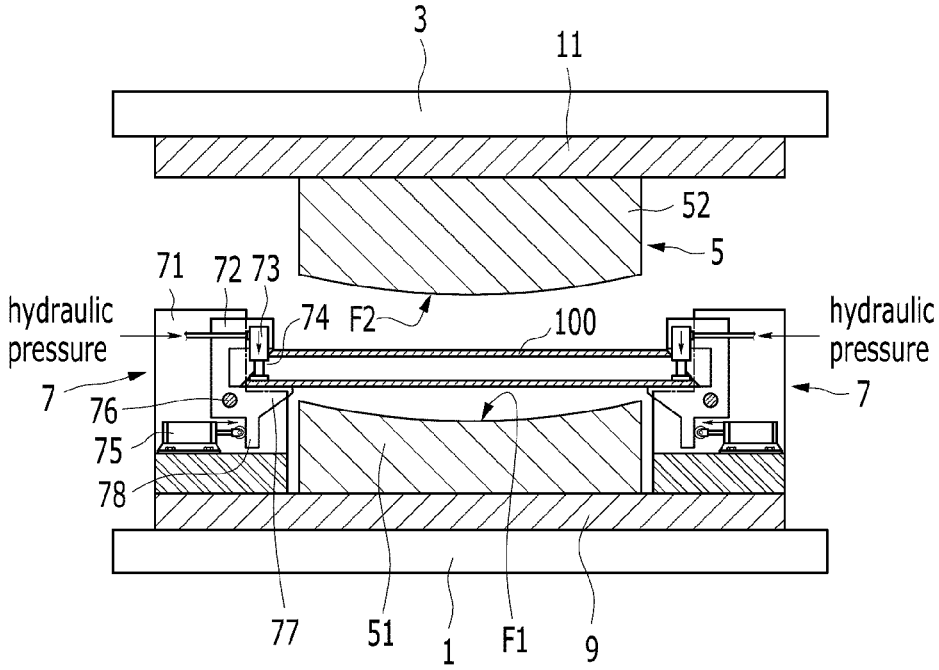

At this state, the clamping cylinders 73 of the pair of clamping units 7 move forward, and the clampers 74 presses and clamps the both end portions of the pipe member 100 laying on the receiving ends 77, as shown in FIG. 5.

At this time, the both end portions of the pipe member 100 are clamped not to slide by the receiving surfaces F3 of the receiving ends 77 and the contact protrusions G or the scratched surfaces formed at the lower surfaces of the clampers 74.

Figure 6:
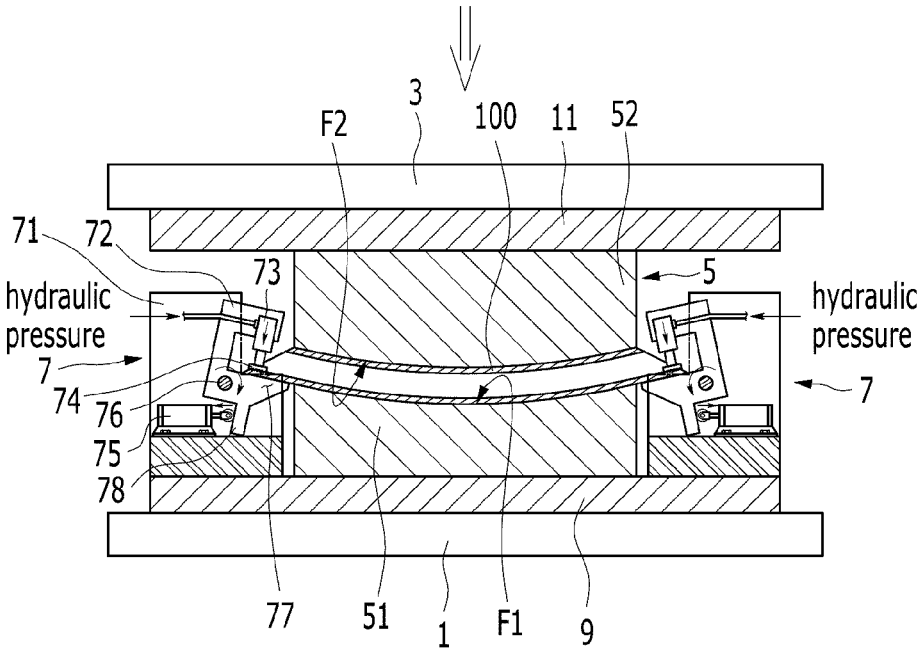

As shown in FIG. 6, the slider 3 moves downwardly and the upper die 52 and the lower die 51 are integrated. At this time, the pipe member 100 are stably deformed plastically along the lower curvature forming surface F1 of the lower die 51 and the upper curvature forming surface F2 of the upper die 52 with both end portions of the pipe member 100 being clamped by the clamping units 7. Therefore, the pipe member 100 is formed to have the predetermined curvature.

In addition, when the pipe member 100 is formed to have the predetermined curvature by the upper die 52 and the lower die 51, the clamping blocks 72 of the clamping units 7 are rotated with respect to the rotation shafts 76. That is, the clamping blocks 72 absorb position changes of the both end portions of the pipe member 100.

Simultaneously, since the clamping units 7 pull the both end portions of the pipe member 100 to opposite directions by rotations of the clamping blocks 72, the pipe member 100 can be stably deformed plastically. Therefore, spring back due to strength of the pipe member 100 may be eliminated and dimensional precision may be enhanced.

In addition, the supporting end 78 pushes the roller 82 of the return spring 75 by the rotation of the clamping block 72 and the rod 81 moves rearward. Therefore, the return spring 75 is compressed.

Figure 7:
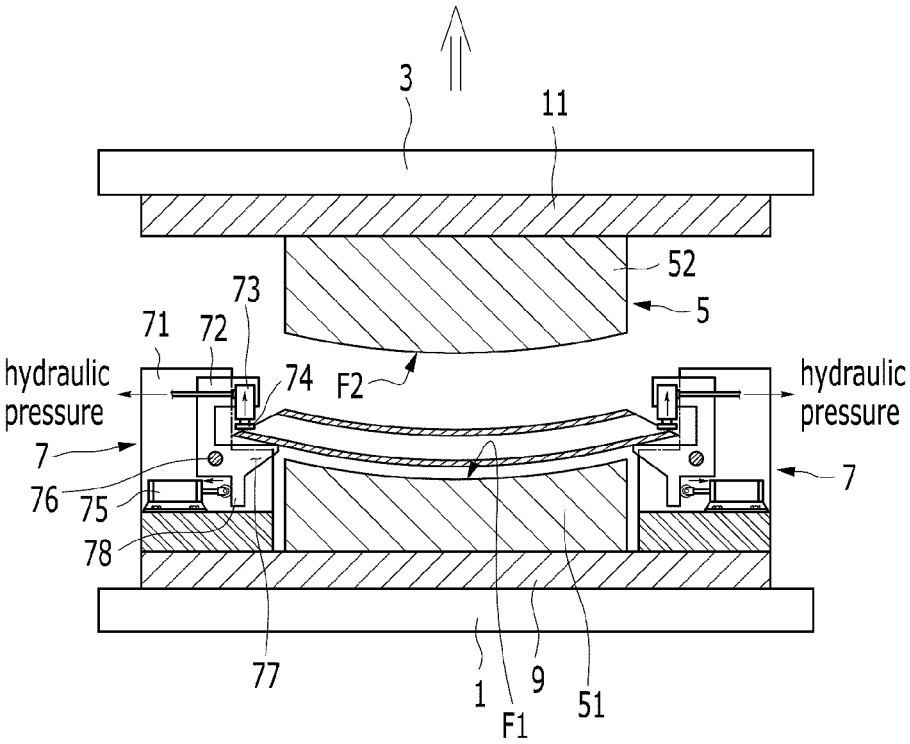

As described above, if curvature forming of the pipe member 100 is completed, the slider 3 moves upwardly and the upper die 52 is separated from the lower die 51, as shown in FIG. 7. Simultaneously, the clamping cylinder 73 moves rearward and clamping forces applied to the both end portions of the pipe member 100 are released.

In this case, the return spring 75 pushes the supporting end 78 through the roller 82 and the clamping block 72 is rotated to its original position. In addition, the clamping blocks 72 returned to their original position raise the both end portions of the pipe member 100 through the receiving ends 77 and the pipe member 100 can be extracted from the lower die 51.

As described above, the bending press system according to an exemplary embodiment of the present invention pulls both end portions of the pipe member 100 by the rotations of the clamping blocks 72 when the pipe member 100 is formed to have the curvature by the curvature die 5 in a state that the both end portions of the pipe member 100 are clamped by the clamping units 7. Therefore, dimensional precision and forming quality may be enhanced due to stable plastic-deformation.

That is, since the position changes of the both end portions of the pipe member 100 are absorbed by the rotations of the clamping blocks 72, stable plastic-deformation may occur. Since spring back due to the strength of the pipe member is eliminated, dimensional precision may be enhanced.

In addition, the curvature is formed by a press method requiring relatively low investment cost. Cycle time may be reduced due to quick pressing and productivity may be improved.

Further, since the clamping unit returns to its original position and raises the pipe member automatically after the curvature is formed, extraction of the pipe member may be facilitated.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A bending press system, comprising:

a base;

a slider disposed above the base and moving downwardly toward the base or moving upwardly from the base;

a curvature die mounted at the base and the slider, and integrated by descent of the slider such that a pipe member inserted in the curvature die is formed to have a predetermined curvature; and a pair of clamping units disposed to be rotatable by a predetermined angle corresponding to the curvature die at both sides of the base, and to clamp both end portions of the pipe member, wherein each clamping unit comprises:

a clamping die fixed on the base and including a space formed therein;

a clamping block positioned in the space of the clamping die, mounted at the clamping die to be rotatable by the predetermined angle through a rotation shaft, and including a receiving end, formed to face the curvature die, and a supporting end formed at a lower portion thereof;

a clamping cylinder mounted at an upper portion of the clamping block to face the receiving end and including an operating rod moving forward or rearward by hydraulic pressure;

a clamper mounted at a front end of the operating rod, to clamp an end portion of the pipe member inserted between the clamper and the receiving end by pressing the end portion of the pipe member together with the receiving end; and a return spring mounted corresponding to a surface of the supporting end in the space of the clamping die, and applying restoring force to the supporting end so as for the clamping block to rotate to an original position of the clamping block, wherein the return spring comprises a rod and a roller mounted at a front end of the rod, and slidably contacts with the surface of the supporting end through the roller.

2. The bending press system of claim 1, wherein the curvature die comprises:

a lower die mounted on the base and including a lower curvature forming surface having the predetermined curvature along a width direction thereof and formed on an upper surface thereof; and an upper die mounted on a lower surface of the slider and including an upper curvature forming surface corresponding to the lower curvature forming surface, having the predetermined curvature along a width direction thereof, and formed on a lower surface thereof.

3. The bending press system of claim 1, wherein a receiving surface for receiving the pipe member is formed on the receiving end, and contact protrusions are formed on the receiving surface.

4. The bending press system of claim 1, wherein a receiving surface for receiving the pipe member is formed on the receiving end and is formed as a scratched surface.

5. The bending press system of claim 1, wherein contact protrusions are formed on a lower surface of the clamper.

6. The bending press system of claim 1, wherein a lower surface of the clamper is formed as a scratched surface.

7. The bending press system of claim 1, wherein the return spring is a hydraulic pressure spring.

8. A bending press system, comprising:

a base;

a slider disposed above the base and moving downwardly toward the base or moving upwardly from the base;

a curvature die including a lower die mounted on the base and an upper die mounted on a lower surface of the slider, wherein the lower die and the upper die are integrated by descent of the slider such that a pipe member inserted between the lower die and the upper die is formed to have a predetermined curvature; and a pair of clamping units to clamp both end portions of the pipe member, each of the pair clamping units comprising a clamping die fixed on both sides of the base and including a space formed therein, a clamping block positioned in the space of the clamping die, mounted at the clamping die to be rotatable by a predetermined angle through a rotation shaft, and including a receiving end formed to face the curvature die and a supporting end formed at a lower portion thereof, a clamping cylinder mounted at an upper portion of the clamping block to face the receiving end and including an operating rod moving forward or rearward by hydraulic pressure, a clamper mounted at a front end of the operating rod to clamp an end portion of the pipe member inserted between the clamper and the receiving end by pressing the end portion of the pipe member together with the receiving end, and a return spring mounted corresponding to a surface of the supporting end in the space of the clamping die and applying restoring force to the supporting end so as for the clamping block to rotate to an original position of the clamping block, wherein the return spring comprises a rod and a roller mounted at a front end of the rod, and slidably contacts with the surface of the supporting end through the roller.

9. The bending press system of claim 8, wherein a lower curvature forming surface having the predetermined curvature along a width direction of the lower die is formed on an upper surface of the lower die.

10. The bending press system of claim 8, wherein an upper curvature forming surface having the predetermined curvature along a width direction of the upper die is formed on a lower surface of the upper die.

11. The bending press system of claim 8, wherein the return spring is a hydraulic pressure spring.

* * * * *